US007946778B2

(12) United States Patent
Gueret

(10) Patent No.: US 7,946,778 B2
(45) Date of Patent: May 24, 2011

(54) DEVICE FOR PACKAGING AND APPLYING A COMPOSITION AND METHOD OF USING SAME

(75) Inventor: Jean-Louis Gueret, Paris (FR)

(73) Assignee: L'Oreal, Paris (FR)

( * ) Notice: Subject to any disclaimer, the term of this patent is extended or adjusted under 35 U.S.C. 154(b) by 1083 days.

(21) Appl. No.: 11/544,807

(22) Filed: Oct. 10, 2006

(65) Prior Publication Data

US 2007/0079845 A1 Apr. 12, 2007

Related U.S. Application Data

(60) Provisional application No. 60/731,229, filed on Oct. 31, 2005.

(30) Foreign Application Priority Data

Oct. 10, 2005 (FR) ..... 05 10335

(51) Int. Cl.
*A46B 11/00* (2006.01)

(52) U.S. Cl. ..... 401/129; 401/126; 401/122

(58) Field of Classification Search ..... 401/121, 401/122, 126, 128–130; 132/317
See application file for complete search history.

(56) References Cited

U.S. PATENT DOCUMENTS

| | | | |
|---|---|---|---|
| 1,480,449 | A | 1/1924 | Kendall |
| 2,630,215 | A | 3/1953 | Lynn |
| 3,309,728 | A | 3/1967 | Seaver |
| 3,817,636 | A | 6/1974 | Ritzenhoff |
| 4,194,848 | A | 3/1980 | Kingsford |
| 4,241,743 | A | 12/1980 | Schnabel et al. |
| 4,261,376 | A | 4/1981 | Kingsford |
| 4,332,494 | A | 6/1982 | Kingsford |
| 4,333,928 | A | 6/1982 | Neef et al. |
| 4,407,311 | A | 10/1983 | Gueret |
| 4,609,300 | A | 9/1986 | Robert |
| 4,628,950 | A | 12/1986 | Bitzer |
| 4,705,053 | A | 11/1987 | Goncalves |
| 4,750,501 | A | 6/1988 | Ackermann et al. |
| 4,770,556 | A | 9/1988 | Ackermann et al. |
| 4,984,919 | A | 1/1991 | Hultgren |
| 5,743,279 | A | 4/1998 | Gueret |

(Continued)

FOREIGN PATENT DOCUMENTS

CN 1374057 A 10/2002

(Continued)

OTHER PUBLICATIONS

English translation of Chinese Office Action, Sep. 19, 2008, pp. 1-8.

(Continued)

*Primary Examiner* — David J Walczak
(74) *Attorney, Agent, or Firm* — Oliff & Berridge, PLC

(57) ABSTRACT

A device for packaging and applying a composition may include: a receptacle configured to contain the composition; an application element configured to apply the composition at least one wiper member configured to wipe the application element; and at least one adjustment member configured to act on the wiper member to modify an inside section of the wiper member. The application element may include a core and projecting elements that extend from the core. The application element may define an envelope surface including at least one cross-section that is off-center relative to the core and/or non-circular. The adjustment member may be movable in turning and/or translation relative to the wiper member.

57 Claims, 9 Drawing Sheets

U.S. PATENT DOCUMENTS

| | | | | |
|---|---|---|---|---|
| 5,746,530 | A | 5/1998 | Oota | |
| 5,918,994 | A * | 7/1999 | Gueret | 401/122 |
| 6,024,507 | A | 2/2000 | Joulia | |
| 6,270,273 | B1 * | 8/2001 | Ohba | 401/122 |
| 6,343,607 | B1 | 2/2002 | Gueret | |
| 6,371,129 | B1 | 4/2002 | Le Bras-Brown et al. | |
| 6,412,496 | B1 | 7/2002 | Gueret | |
| 6,503,487 | B1 | 1/2003 | Ohba | |
| 6,539,950 | B1 | 4/2003 | Gueret | |
| 6,546,937 | B2 | 4/2003 | Gueret | |
| 6,581,610 | B1 | 6/2003 | Gueret | |
| 6,655,390 | B2 | 12/2003 | Gueret | |
| 6,662,810 | B2 | 12/2003 | Gueret | |
| 6,675,814 | B2 | 1/2004 | Gueret | |
| 6,676,320 | B1 | 1/2004 | Wainer | |
| 6,814,084 | B2 | 11/2004 | Gueret | |
| 6,866,046 | B2 | 3/2005 | Gueret | |
| 2001/0009629 | A1 | 7/2001 | Gueret | |
| 2002/0011251 | A1 | 1/2002 | Gueret | |
| 2002/0124860 | A1 | 9/2002 | Gueret | |
| 2002/0139385 | A1 | 10/2002 | Gueret | |
| 2003/0089379 | A1 | 5/2003 | Gueret | |
| 2003/0178043 | A1 | 9/2003 | Gueret | |
| 2003/0213498 | A1 | 11/2003 | Gueret | |
| 2004/0134507 | A1 | 7/2004 | Gueret | |
| 2004/0226573 | A1 | 11/2004 | Gueret | |
| 2004/0240926 | A1 | 12/2004 | Gueret | |

FOREIGN PATENT DOCUMENTS

| | | | |
|---|---|---|---|
| DE | 3240151 | A1 | 5/1984 |
| EP | 0 219 138 | A2 | 4/1987 |
| EP | 0 611 170 | A1 | 8/1994 |
| EP | 1 060 686 | A1 | 12/2000 |
| FR | 2 198 713 | | 4/1974 |
| FR | 2 515 941 | | 5/1983 |
| FR | 2 563 712 | | 11/1985 |
| FR | 2 580 479 | | 10/1986 |
| FR | 2 605 198 | | 4/1988 |
| FR | 2 738 125 | | 3/1997 |
| JP | U-58-136014 | | 9/1983 |
| JP | U-61-20974 | | 6/1986 |
| JP | U-01-22571 | | 7/1989 |
| JP | A 8-228829 | | 9/1996 |
| JP | A 8-289815 | | 11/1996 |
| JP | A 10-9128 | | 1/1998 |
| JP | A 10-117840 | | 5/1998 |
| JP | A 11-4714 | | 1/1999 |
| JP | A 11-244043 | | 9/1999 |
| JP | A 2000-37227 | | 2/2000 |
| JP | A 2000-66642 | | 3/2000 |
| JP | A 2001-239 | | 1/2001 |
| JP | A 2001-61545 | | 3/2001 |
| JP | A 2001-61548 | | 3/2001 |
| JP | A 2001-327326 | | 11/2001 |
| WO | WO 98/00045 | | 1/1998 |

OTHER PUBLICATIONS

Mar. 10, 2010 Office Action issued in Japanese Application No. 2006-115426 (with translation).

Nov. 17, 2010 Office Action issued in U.S. Appl. No. 11/398,655.

May 28, 2010 Office Action issued in U.S. Appl. No. 11/398,655.

Jul. 29, 2009 Office Action issued in U.S. Appl. No. 11/398,655.

* cited by examiner

DEVICE FOR PACKAGING AND APPLYING A COMPOSITION AND METHOD OF USING SAME

This non provisional application claims the benefit of French Application No. 05 10335 filed on Oct. 10, 2005 and U.S. Provisional Application No. 60/731,229 filed on Oct. 31, 2005, the entire disclosures of which are incorporated herein by reference.

The present invention relates to devices for packaging and applying makeup, a cosmetic, or a care product for application to skin, to mucous membranes, to hairs, or to nails, for example, mascara for eyelashes and/or eyebrows.

For example, aspects of the invention may be applied to packaging and applicator devices including both a wiper member for wiping an applicator being passed therethrough, and means for acting on the wiper member to modify an inside section so that the wiper member wipes an applicator to a greater or lesser extent.

BACKGROUND

Such devices are known, for example, from the following French patent applications: FR 2 563 712, FR 2 580 479, FR 2 515 941, from U.S. Pat. Nos. 4,194,848, 4,609,300, 6,676,320, 4,261,376, 4,332,494, 4,333,928, 6,503,487, and from the following patent applications EP-A-1 060 686, DE-A1-32 40 151, WO 98/00045, EP-A2-0 219 138, JP-11-004714, JP-10-117840, JP-2001-061545, JP-2001-061548, JP-11-244043, JP-2000-037227, JP-10-9128, JP-08-289815, JP-2001-327326, JP-2001-000239, JP-2000-66642, JP-08-228829, or JP-2001-000239.

French patent application FR 2 605 198 also discloses a makeup kit including a stiffener device for adjusting stiffness of a wiper lip of a wiper member.

In such patents and patent applications, the applicator comprises a mascara brush that is generally cylindrical in shape, including a rectilinear core that extends in line with a stem.

French patent application FR 2 738 125 discloses a mascara packaging device configured in such a manner that a user may adjust wiping by pressing on a container which is made of flexible material. As disclosed, the applicator comprises a handle with tufts of bristles implanted parallel to a mean plane of the handle.

U.S. Pat. No. 4,241,743 discloses a mascara applicator device including a wiper member, means for acting thereon to modify an inside section thereof, and an applicator comprising a brush including a twisted core that extends along a curvilinear axis, the brush being of circular cross-section and including a diameter that decreases going toward a free end thereof.

In known devices with variable wiper members, a quantity of composition present on the applicator may be modified by the user acting on an adjustment of the wiper member.

SUMMARY

There exists a need to further improve devices to enable a user to modify a quantity of composition taken up by an applicator, for example, to give the user an option of varying the quantity of composition to a relatively large extent, without leading to makeup being applied less well and without harming the ease of use of the device.

The invention seeks, for example, to satisfy this need.

Exemplary embodiments of the invention may provide a device for packaging and applying a composition, the device comprising: a receptacle configured to contain the composition; an application element configured to apply the composition, the application element comprising a core and projecting elements that extend from the core, the application element defining an envelope surface including at least one cross-section that is off-center relative to the core and/or that is non-circular; a single wiper member configured to wipe the application element; and at least one adjustment member configured to act on the wiper member to modify an inside section of the wiper member, thus enabling the application element engaged therethrough to be wiped to a greater or lesser extent.

The particular shape of the envelope surface may enable an amount of composition taken up by the application element to be varied to a greater extent with variation in the cross-section of the wiper member.

In exemplary embodiments, a range over which the inside section of the wiper member varies may be selected in such a manner as to include an effect on the quantity of composition picked up by the application element and/or on the result of the composition being applied. In exemplary embodiments, the user may modify the amount of composition taken up by the application element at will and may create on the application element different quantities of composition, thus forming, for example, zones carrying a large amount of composition and zones carrying little or no composition.

Such a device may operate reliably, may be easy to use and may enable novel makeup effects to be obtained, where appropriate or desired.

In exemplary embodiments, the adjustment member may be movable in turning or/and in translation relative to the wiper member.

In exemplary embodiments, movement of the adjustment member may be a simple rotation or a simple translation, or a combination of both, for example, an helical movement, or a combination of one or more rotation(s) and/or of one or more translation(s), or a more complex movement, comprising at least one instantaneous component of rotation and/or translation.

The device may comprise only one wiper member.

The application element may include projecting elements of different lengths, for example, so as to encourage retention of composition in certain zones and to encourage stronger wiping in other zones, as a function of the adjustment made by the user. For example, the adjustment may be selected in such a manner that the longest projecting elements of the application element are wiped more than the shortest projecting elements, for example, to comb and separate eyelashes or eyebrow hairs. After being wiped and because of the adjustment performed by the user, the application element may thus include zones that are practically without any composition, thus making it easier to separate the eyelashes or hairs of the eyebrows.

For example, the user may begin by bringing the eyelashes into contact with a zone of the application element that is carrying a relatively large amount of composition, and then bring the eyelashes into contact with another zone that is carrying less composition, to separate the eyelashes. The user may also bring the eyelashes into contact with only one of the zones of the application element, depending on the kind of makeup effect that is desired.

Exemplary embodiments of the invention may make it possible to obtain differences in wiping that are more marked than those that may be obtained with a prior art brush that is circularly symmetrical, for example, being cylindrical or football-shaped, because of the shape of the application element.

With a brush, the envelope surface may be defined by free ends of bristles.

With a comb, the envelope surface may be defined by a cross-sectional shape of the comb.

The envelope surface may be of cross-section that is constant along a major fraction of a length of the application element, or indeed over substantially an entire length thereof.

In exemplary embodiments, the envelope surface may include at least a portion of cross-section that varies, for example, by changing in size, but not in shape. The cross-section of the envelope surface of the application element may pass through at least one extremum between two axial ends thereof, where the extremum may be a maximum or a minimum, for example.

The cross-section of the envelope surface, at at least one point along the core, may include a general shape selected from: polygonal, triangular, square, pentagonal, hexagonal, oblong, oval, elliptical, lenticular, star-shaped, for example, including three to six points, or keyhole-shaped.

The cross-section of the envelope surface may be off-center relative to the core at at least one point along a length of the application element.

The envelope surface may extend along a longitudinal axis that is optionally rectilinear, making a non-zero angle with a longitudinal axis of the core.

The application element may extend along a longitudinal axis that is situated entirely on one side of a plane containing a longitudinal axis of the device.

The application element may include a free end constituting a point of the application element that is furthest from the longitudinal axis of the device.

The core of the application element may be rectilinear or curved. The application element may be curved about one axis or about at least two axes that are not mutually parallel, which axes may extend, for example, in directions that are perpendicular.

The envelope surface of the application element need not be symmetrical relative to a midplane perpendicular to the core.

The envelope surface of the application element may include a shape that generally tapers toward a distal end thereof, or toward both the distal end and a proximal end thereof.

The application element may be secured to an end of a stem.

Longitudinal axes of the stem and the application element may be in alignment. In exemplary embodiments, the longitudinal axes of the stem and the application element may form a non-zero angle therebetween, for example, an angle lying in a range of 0 to 30°, for example, 1° to 20°, or 2° to 10°.

The angle between the longitudinal axis of the stem and the longitudinal axis of the core at any point therealong may be less than 90°.

In exemplary embodiments, the stem may be connected to a handle member. The handle member may be configured in such a manner as to close in a leaktight manner the receptacle containing the composition for application. The handle member may thus comprise a closure cap for the receptacle, which cap may be configured to co-operate with the receptacle by screw-fastening.

The application element may be a brush.

Under such circumstances, the projecting elements may comprise bristles extending from the core. The core may comprise at least one twisted metal wire. The core may be twisted with a left-handed twist or a right-handed twist.

In exemplary embodiments, the core is not twisted, and the bristles are engaged, for example, in orifices in the core, with the core being overmolded onto the bristles, for example, being injection-molded onto the bristles, for example, using a second material that is different from a material of the bristles.

The bristles may be resilient.

The application element may be made from a blank from which one or more notches and/or facets are cut. For example, it is possible to make notches in the blank that include a cross-section of a shape that is outwardly convex.

The application element may include at least one longitudinal ridge, and, for example, two to eight ridges.

The envelope surface of the application element may include at least one face that is planar or concave. The application element of the application element may include at least one face that is convex, and that includes a radius of curvature, when the application element is observed in cross-section, that is greater than a length of a longest bristle projecting from the core.

The application element may include at least one notch, for example, a succession of notches. During wiping, the application element need not be wiped down to bottoms of the notches. The user may select to adjust the wiper member so as to enable the application element to be wiped lightly, so that after wiping the notches remain filled with composition.

A notch may include at least a portion of cross-section that is constant in shape on going along the application element. The notch may, for example, include a cross-section that is entirely constant going along the application element.

A notch may be defined circumferentially by at least one substantially radial face, for example, and, for example, may be defined by two substantially radial faces.

An angular extent of a notch in a plane extending across the core may be less than 360°, or less than 180°, or indeed less than 120°. The notch may extend over an angular extent around the axis of the application element but may lie in a range of 20° to 180°, for example, over an angular extent that lies in one of the following ranges of angles: 40° to 50° and 110° to 130°. The notch may extend over a circumferential dimension that is greater than an axial dimension thereof. A notch may extend along the application element over a length that lies in a range of 1.5 millimeters (mm) to 6.5 mm. For example, a notch may include a maximum depth lying in a range of 2.5 mm to 4 mm. A notch may extend over at least 4/10ths of a length of a portion of the application element carrying bristles, or indeed over less than 3/10ths of the length. A notch may include a depth that goes substantially as far as the core, for example.

The application element may be a comb and the projecting elements may be teeth. The application element may include teeth made integrally, i.e., monolithically, with the core. The teeth may be made by molding, for example, by injection-molding together with the core, or by machining, or by stamping. The core may be injection-molded onto the teeth, for example, being made of a second material that is different from a material of the teeth.

The application element may include at least one row of teeth, or at least two rows of teeth, for example, three or four rows of teeth.

The teeth of a row of teeth may be spaced apart equally or unequally.

At least two teeth may extend in respective different directions from the core.

At least one tooth of a first row of teeth may extend in a first direction, at least one tooth in a second row of teeth may extend in a second direction, and the first and second directions may make an angle that is less than 180°, or less than 140° or 135°, better an angle that is less than or equal to 120°, or less than or equal to 110°, or indeed about at least 90°, therebetween. Most or all of the teeth of a first row may extend in the first direction. Most or all of the teeth in a second row may extend in the second direction.

The teeth of at least one of the rows may substantially extend at least one of face of the core.

The rows of teeth may be disposed around the longitudinal axis of the core.

The rows may extend substantially parallel to the longitudinal axis of the core.

The core may include a cross-section of a shape that is selected from: oval, oblong, elliptical, lenticular, circular, polygonal, triangular, square, pentagonal, hexagonal, or octagonal, this list not being limiting.

The core and the projecting elements may be made by molding, for example, injection-molding a plastics material, a thermoplastic or a thermoplastic elastomer, for example, of a material selected from: polyolefin, for example polyethylene (PE) or polypropylene (PP), polyamide (PA), polyethylene terephthalate, polyoxyethylene, polystyrene, polycarbonate, PEBAX®, styrene-ethylene and butylene-styrene copolymer (SEBS), polyurethane (PU), nitrile rubber (EPDM), ethylene vinyl acetate (EVA), polyester, HYTREL®, this list not being limiting.

The core and/or the projecting elements may be magnetic. For example, the core and/or the projecting elements may include dispersed magnetic particles with permanent magnetism or particles that are magnetizable.

At least one row of projecting elements may comprise more than twenty projecting elements, for example, twenty-five projecting elements, or even, for example, thirty projecting elements.

A height of the projecting elements, as measured from the support, may lie in a range of 0.5 mm to 10 mm, and, for example, in a range of 1 mm to 4 mm.

At least one projecting element may be substantially pyramid-shaped.

At least two projecting elements may form at least one V-shaped groove, when the core is observed in a direction that is substantially perpendicular to a longitudinal axis thereof.

The application element may comprise an optionally-flocked endpiece. The endpiece may comprise a body of elastomer material.

The endpiece may also comprise a felt or a foam.

Deformation of the wiper member may result from relative movement between a first element and a second element. The first and second elements may be of any kind.

In exemplary embodiments, to act on the wiper member, the device may comprise: a first element including an axis and comprising at least one slot that does not extend entirely perpendicularly to the axis; and a second element engaged at least partially in the first element and being configured to turn relative thereto about the axis and also being configured to move axially within the first element. The second element may comprise at least one lug engaged in the slot and visible from outside the device. The slot and the lug may be configured in such a manner that displacement of the lug within the slot during relative turning of the first and second elements causes the two elements to be moved axially relative to each other.

There may be a single lug of any shape, for example, of optionally-circular section, optionally made integrally, i.e., monolithically, with the second element.

The device may comprise on an outside surface thereof at least one visible mark associated with a particular relative position of the first and second elements, for example, a plurality of marks corresponding to different positions of the lug in the slot, each mark comprising, for example, at least one alphanumeric character or a pictogram.

For example, the slot may extend angularly over less than 180°, for example, over about 120° around the axis. The slot may include at least one edge that is smooth or notched. The notch may make it easier, where appropriate or desired, to position the second element relative to the first element in at least one predefined position. The existence of at least one notch may also form at least one hard point that may be felt by the user when the lug passes thereover, and where appropriate or desired, such passage may be accompanied by a clicking sound. The presence of at least one notch may also make it easier to hold the lug in a predefined position while the device is being carried about, for example, in a handbag.

The slot may include an inclination relative to the axis that is selected such that an axial stroke of the second element relative to the first between extreme positions of the lug in the slot lies in a range of about 1 mm to about 10 mm, for example, in a range of 1 mm to 8 mm, or indeed in a range of 2 mm to 5 mm, for example.

The lug may include a length that is greater than or equal to a thickness of a wall of the first element through which the slot passes, for example, making it possible to improve retention of the second element in the first element and/or making the lug more visible. The lug may alternatively be shorter than the thickness of the wall in the first element through which the slot passes, for example, making the lug easier to put into place.

The first and second elements may be configured so as to enable the lug to be inserted into the slot by elastically deforming at least one of the first and second elements, while the second element is being moved inside the first.

In the inside surface thereof, the first element may comprise at least one groove configured to make it easier to move the lug between the end of the first element through which the second element is inserted and the slot. For example, the groove may open into the end of the first element.

The notch may include a free end that is rounded or chamfered, which may improve appearance and may also make it easier to put the lug into the slot.

The first element may be made integrally, i.e., monolithically, by molding a plastics material. The same may apply to the second element.

In exemplary embodiments, the second element may include an end portion that projects permanently outside the first element. The end portion may comprise an external skirt, which may be fluted or grained, for example, to make it easier for the user to drive.

The second element may also comprise a body that is closed at one end. When the end portion includes an external skirt, the external skirt may be configured to extend around a bottom of the body.

The body may constitute the receptacle configured to contain the composition, for example, a cosmetic or a dermatological composition, for example, mascara.

The application element may, for example, be secured in a releasable manner on the first element to be extracted from the device for application purposes and then reinserted into the device to be refilled with composition.

The application element may be configured to be received in the second element when in position on the receptacle.

The wiper member may be disposed in such a manner as to be deformed to a greater or lesser extent depending on a relative positioning between the first and second elements. The wiper member may comprise a fitted insert or may be molded integrally, i.e., monolithically, with one of the first and second elements.

The wiper member may be disposed, for example, on one of the first and second elements, for example, being secured to the second element, and may be deformed by the other element, depending on a relative axial positioning of the two elements.

The wiper member may be configured so as to deform in elongation or in compression. The wiper member may be configured so as to deform by being splayed apart.

When deformation is in elongation, the wiper member may comprise, for example, a central portion fitted with a transverse wall, for example, an end wall that is pierced by an opening, and the first element may comprise an internal extension that bears against the end wall to a greater or lesser extent depending on the relative positioning of the first and second elements, thereby changing a shape of the opening, for example, enlarging the opening to a greater or lesser extent.

When deformation is in compression, the deformable wiper member may be, for example, of a material that is elastically compressible, such as a foam.

This elastically compressible material may include a hardness that depends on a degree to which it has been compressed. This may enable the user to modify wiping characteristics of the elastically compressible material, for example.

The wiper member may be configured to deform in shear. The device may include, for example, an adjustment member configured to turn a first end of the wiper member relative to a second end of the wiper member.

The device may also comprise a button configured to be moved in translation in a direction perpendicular to a longitudinal axis of the device.

The wiper member may comprise a rim co-operating with the central portion to define an annular groove in which the second element is engaged.

The transverse wall may comprise at least one slot that facilitates deformation of the wiper member by including an extension of the first element pressed thereagainst. For example, the transverse wall may comprise a plurality of substantially radial slots.

The internal extension of the first element acting on the wiper member may be made integrally, i.e., monolithically, with a remainder of the first element by molding. The internal extension may be tubular in shape. The internal extension may also perform a wiping function, where appropriate or desired.

In exemplary embodiments, the wiper member may comprise a plurality of tongues molded integrally, i.e., monolithically, with one of the first and second elements, while the other one of the second and first elements may include a surface against which the tongues may be brought to bear as a function of the relative axial position of the first and second elements.

The surface may be disposed in such a manner that the tongues bend to a greater or lesser extent depending on the relative axial positioning of the first and second elements.

The tongues may define an opening configured to wipe the application element. The opening may thus include a dimension that the user may vary by turning the first element relative to the second. The surface configured to press against the tongues may, for example, be conical, converging toward an inside of the receptacle.

The first element may include an outer wall that is generally cylindrical, with the slot passing therethrough, the outer wall including, for example, substantially a same outside diameter as an end portion of the second element.

The device may comprise a stem provided with a setback in a region of the stem that comes into registration with the wiper orifice when the device is closed. The setback may extend over a length that is greater than or equal to a maximum displacement stroke of the second element relative to the first. This may serve to avoid or reduce stress exerted by the stem on the wiper member when the application element is in place, regardless of an angular orientation of the first element relative to the second.

Independently or in combination with the above, exemplary embodiments of the invention may provide a packaging and applicator device of a composition, comprising: a receptacle configured to contain the composition; an application element configured to apply the composition, the application element comprising a core and projecting elements that extend from the core, the application element defining an envelope surface including at least one cross-section that is off-center relative to the core and/or that is non-circular; at least one wiper member configured to wipe the application element; and at least one adjustment member configured to act on the wiper member to modify an inside section thereof, the adjustment member being configured to enable the inside section of the wiper member to be modified in a continuous manner.

Independently or in combination with the above, exemplary embodiments of the invention may provide a packaging and applicator device of a composition, comprising: a receptacle configured to contain the composition; an application element configured to apply the composition, the application element comprising a core and projecting elements that extend from the core, the application element defining an envelope surface including at least one cross-section that is off-center relative to the core and/or that is non-circular; at least one wiper member configured to wipe the application element; and at least one adjustment member configured to act on the wiper member to modify an inside section thereof, modification of the wiper member being a result of relative movement between a first element and a second element.

Independently or in combination with the above, exemplary embodiments of the invention may provide a packaging and applicator device of a composition, comprising: a receptacle configured to contain the composition; an application element configured to apply the composition, the application element comprising a core and projecting elements that extend from the core, the application element defining an envelope surface including at least one cross-section that is off-center relative to the core and/or that is non-circular; at least one wiper member configured to wipe the application element; and at least one adjustment member configured to act on the wiper member to modify an inside section thereof, at least a portion of the adjustment member being axially movable.

Independently or in combination with the above, exemplary embodiments of the invention may provide a packaging and applicator device of a composition, comprising: a receptacle configured to contain the composition; an application element configured to apply the composition, the application element comprising a core and projecting elements that extend from the core, the application element defining an envelope surface including at least one cross-section that is off-center relative to the core and/or that is non-circular; at least one wiper member configured to wipe the application element; and at least one adjustment member configured to act on the wiper member to modify an inside section thereof, the wiper member being configured to deform in elongation, in compression, in shear, or by splaying out.

The projecting elements of at least one row may include bases that are substantially in alignment.

The projecting elements of at least one row may be disposed at least in part on either side of a geometrical separation plane extending along the longitudinal axis of the core.

The projecting elements of a first row may include bases with centers that occupy a same axial position along the longitudinal axis of the core as occupied by centers of bases of the projecting elements of a second row. In exemplary embodiments, the centers of the bases of the projecting elements of a first row may be situated axially between the centers of the bases of the projecting elements of a second row.

At least two consecutive projecting elements in a row may touch. In exemplary embodiments, at least two consecutive projecting elements of a row need not be touching.

In exemplary embodiments, none of the projecting elements is internally hollowed out.

The projecting elements in two different rows need not include a same spacing.

BRIEF DESCRIPTION OF THE DRAWINGS

Various details of the present invention may will be better understood on reading the following detailed description of non-limiting embodiments, and on examining the accompanying drawings, in which.

DETAILED DESCRIPTION OF EMBODIMENTS

Figure 1:
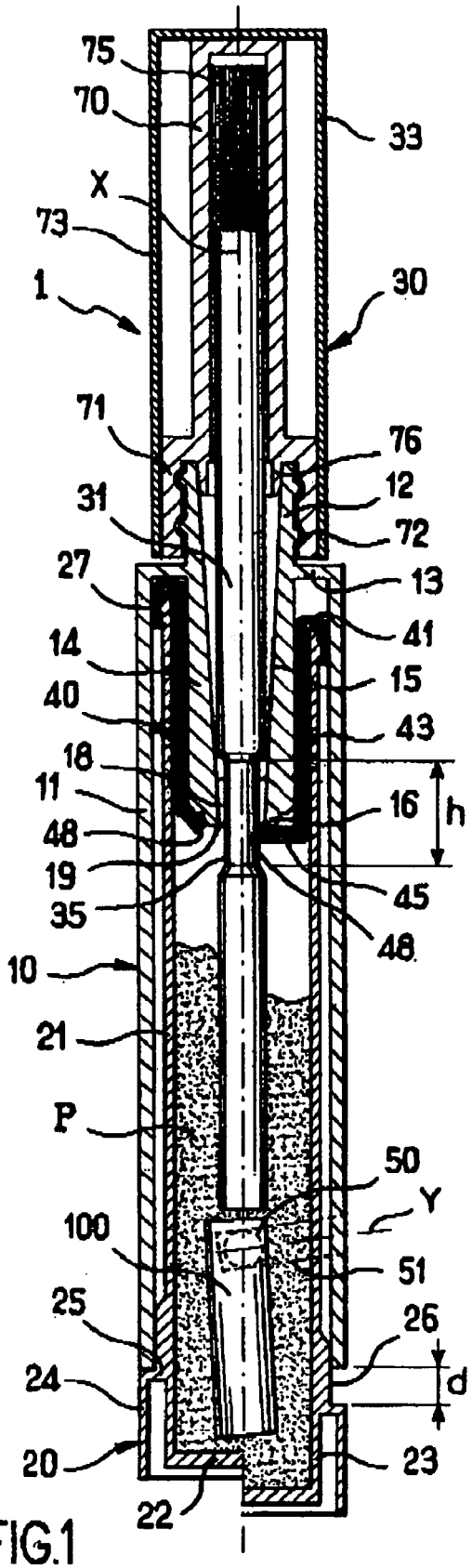
FIG. 1 combines two diagrammatic longitudinal half-cross-sectional views of an exemplary device, illustrated with the lug in two respective positions in the slot.
Figure 2:
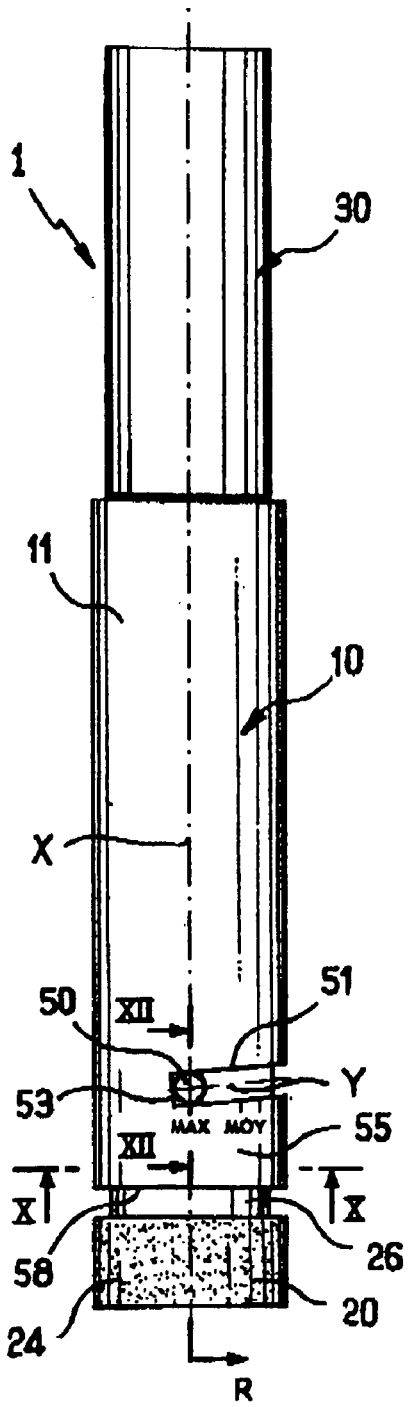
FIG. 2 is a diagrammatic elevation view of the device of FIG. 1.

The exemplary packaging and applicator device 1 illustrated in FIGS. 1 and 2 may comprise a first element 10 and a second element 20 capable of turning relative to the first element 10 about a longitudinal axis X of the device.

The device 1 may also include an applicator 30, which, in exemplary embodiments, may comprise a stem 31 of axis X provided at one end with an application element 100 and at its other end with a handle member 33.

As illustrated in FIG. 1, the first element 10 may include a generally cylindrical wall 11 about the axis X that is extended at a top end thereof by a neck 12 with a bottom end that is connected to a transverse wall 13.

In exemplary embodiments, the first element 10 may also include an internal extension 14 of tubular shape that defines an insertion cone 15 for the application element that converges toward the inside of the receptacle and that is provided at a bottom end with an annular bead 16.

In exemplary embodiments, the second element 20 may include a generally tubular body 21 about the axis X that is closed at a bottom end by a bottom 22, thereby constituting a receptacle containing the composition. The bottom portion 23 of the body 21 may be surrounded by an external skirt 24 with an outside surface that is grained, as illustrated in FIG. 2. In exemplary embodiments (not illustrated), the outside surface may be fluted.

A top end of the skirt 24 may meet a transverse wall 25 that joins the body 21 perpendicularly. The wall of the body may become thicker above the transverse wall 25 so as to form a cylindrical guide surface 26 of outside diameter that matches an inside diameter of the bottom end of the wall 11. A height of the guide surface 26 may be sufficient to ensure that regardless of the angular position of the second element 20 relative to the first element 10, the surface 26 remains substantially in contact with the inside surface of the wall 11.

At a top end, on a radially outer surface thereof, the body 21 may include an annular bead 27 that may serve to secure a wiper member 40. The top end of the wiper member may include an annular rim 41 configured to snap-fasten on the bead 27. The rim 41 may be connected to a tubular skirt 43 that extends into the annular space formed between the internal extension 14 and the top portion of the body 21.

Figure 3:
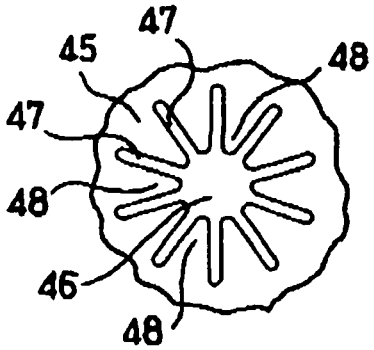
FIG. 3 is a fragmentary and diagrammatic face view illustrating the end wall of the wiper member in isolation.

In a bottom portion thereof, the wiper member 40 may include a transverse wall 45 pierced by a central orifice 46 and by a plurality of slots 47 forming fins 48 between one another, as illustrated in FIG. 3.

Figure 4:
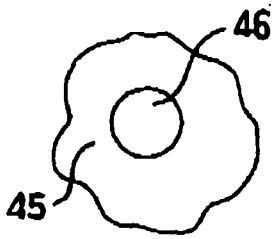
FIG. 4 is a view analogous to FIG. 3 illustrating another exemplary embodiment.

As illustrated in FIG. 4, the transverse wall 45 may be pierced by a single orifice 46 of circular section, without slots 47. Where appropriate or desired, this may make it possible to obtain a leaktight contact between the wiper member and the stem 31 of the applicator, for example, during storage.

The body 21 may serve as a receptacle and may contain a composition P, for example, makeup, a cosmetic, or a care product, for example, mascara.

The second element 20 may be provided with a lug 50 and the first element 10 may include a slot 51 that passes through the wall 11 and including a longitudinal axis Y that extends over a portion of a helix, for example, with an annular extent of about 120° about the axis X, for example.

Figure 5:
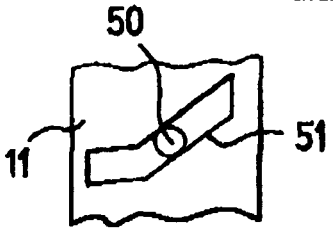
FIGS. 5 and 6 are fragmentary and diagrammatic face views illustrating a portion of the first element including the slot, in two exemplary embodiments.
Figure 6:
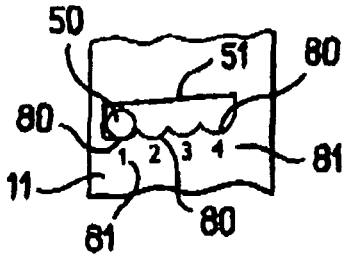

FIG. 5 illustrates the possibility of the slot 51 extending other than along a single portion of a helix, and FIG. 6 illustrates the possibility of at least one of the edges of the slots 51 including notches 80. For example, at least one of the notches may be associated with a mark 81 that may be of use to the user, such as a digit or a letter.

For example, an inclination of the slot 51 may permit a maximum stroke d in the axial direction lying in a range of 2 mm to 3 mm when the lug 50 passes from one extreme position to the other, as a result of the second element 20 turning relative to the first element 10.

Figure 7:
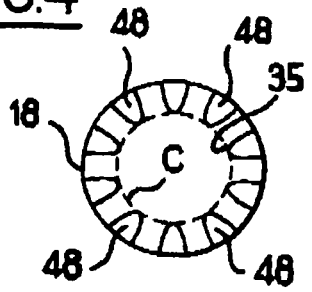
FIGS. 7 to 9 illustrate a shape of the wiper orifice as seen from above from the opening for inserting the application element, for different positions of the lug in the slot.

When the second element 20 is in a low abutment position corresponding to FIG. 2, so that the lug 50 comes to press against the left-hand end 53 of the slot 51, the bottom end 19 of the internal extension 14 may leave the wall 45 of the wiper member 40 substantially undeformed and the fins 48 may extend maximally toward the insides of the circular orifice 18 defined by the bottom end of the insertion cone 15, as illustrated in FIG. 7. Wiping may then be at a maximum and a fill of composition on the application element may be at a minimum.

As illustrated in FIG. 1, the stem 31 may advantageously include an annular setback 35 of diameter corresponding substantially to a diameter of a circle C defined by the tips of the fins 48 in the configuration of FIG. 7. Thus, the stem 31 may not exert any stress, or may exert relatively little stress, on the wiper member, thereby reducing the risk of the wiper member becoming permanently deformed.

Figure 8:
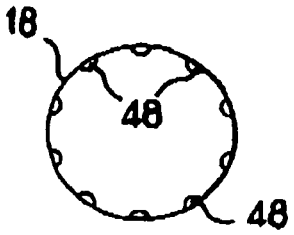
Figure 9:
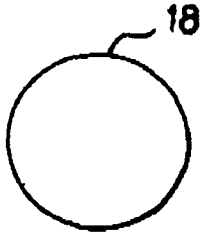

When the second element is turned in the direction of arrow R in FIG. 2, the lug 50 may move along the slot 51 and may rise relative to the first element 10. The internal extension 14 may press downward against the wall 45, and the fins 48 may be splayed apart. The fins may then project over a shorter distance toward the inside of the orifice 18, as illustrated in FIG. 8. At the end of the turning stroke in the direction of arrow R, the lug 50 may reach a high abutment position corresponding to the left-hand half-section in FIG. 1, and the fins 48 may project hardly at all into the orifice 18, as illustrated in FIG. 9.

In exemplary embodiments, the internal extension 14 may not pass through the transverse wall 45. In exemplary embodiments that are not illustrated, an axial displacement stroke of the internal extension 14 may be sufficiently great to ensure that the internal extension 14 passes right through the wiper member 40.

A person skilled in the art will understand from this description how to select a degree of deformation of the wiper member as a function of a looked-for result, for example, depending on whether or not it is desired to conserve wiping in all positions of the lug in the slot, or to be able to wipe solely against the edge of the internal extension in a given position.

For example, there may be two positions corresponding respectively to wiping against an elastically deformable wiper member and wiping against the internal extension. In exemplary embodiments, it may also be possible to include at least one position in which there is no wiping, by making the internal extension in such a manner that it cannot normally wipe the application element.

The setback 35 may preferably extend over a height h that may be greater than the maximum axial stroke d of the second element relative to the first element, so that whatever the position of the lug 50 in the slot 51, the setback 35 may be always in registration with the ends of the fins 48. In exemplary embodiments (not illustrated), the stem need not include a setback.

Figure 10:
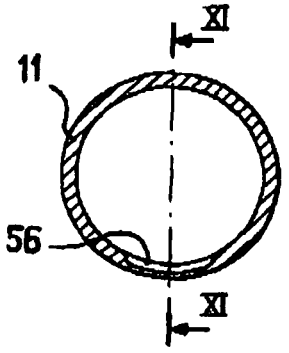
FIG. 10 is a cross-sectional view taken along X-X of the end portion of the first element.

To assemble the device 1, the wiper member 40 may be, for example, secured to the second element 20, and then the second element may be inserted into the first element. To make it easier for the lug 50 to go past the bottom portion 55 of the first element 10, the wall 11 of the first element may advantageously include a groove 56 in a radially inner wall thereof, for example, extending from the bottom end 58 of the wall 11, as illustrated in FIG. 10.

Figure 11:
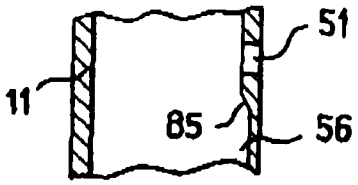
FIG. 11 is a fragmentary longitudinal cross-sectional view taken along XI-XI of FIG. 10.

The groove 56 may optionally include a top ramp 85 that is configured to make it easier to pass the lug, as illustrated in FIG. 11.

Figure 12:
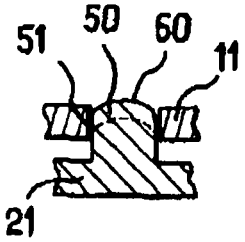
FIG. 12 is a diagrammatic and fragmentary cross-sectional view taken along XII-XII of FIG. 2.

The lug 50 may include a rounded top end 60, as illustrated in FIG. 12, for example, so as to make it easier to pass over the bottom portion 55.

Figure 13:
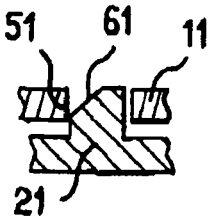
FIG. 13 is a view analogous to FIG. 12 illustrating another exemplary embodiment of the lug.

As illustrated in FIG. 13, the lug may include a chamfer 61.

The groove 56 may be positioned relative to the slot 51 in such a manner that, after moving along the axis X in the groove 56, the lug 50 reaches a position adjacent to the end 53.

For example, a length of the lug may enable the lug to project a little through the slot 51, as illustrated in FIG. 12. As illustrated, a dashed line represents the possibility, in exemplary embodiments, for the lug 50 to include a shorter length so as to remain set back from the outside surface of the second element.

The lug may optionally be colored in such a manner as to show up more clearly, and under such circumstances the lug may be made, for example, by dual injection of material together with a remainder of the second element 20.

For example, the stem 31 may be engaged in an under-capsule 70 of the handle member, the under-capsule 70 possibly including an assembly skirt 71 with an internal thread configured to be suitable for screwing onto an external thread 72 on the neck 12. The assembly skirt 71 may carry an outer cap 73, for example, of metal.

At a top end thereof, the stem 31 may include fluting 75 that enables the stem 31 to be engaged by force in the under-capsule 70.

As illustrated, the under-capsule 70 may also include a sealing lip 76 that comes to press against the radially inside surface of the neck 12 once the under-capsule 70 has been screwed home on the neck 12. Naturally, the handle member may be secured in some other way on the first element 10, for example, by friction or by snap-fastening.

As illustrated in FIG. 1, the application element 100 may comprise a brush comprising a twisted core 102 and projecting elements 103 constituted by bristles extending from the core. The exemplary application element 100 is illustrated in greater detail in FIG. 14. The application element 100 may define an envelope surface E including at least one cross-section that may be off-center relative to the core 102.

The envelope surface E may extend along a longitudinal axis W that may be at a non-zero angle $\alpha$ relative to the longitudinal axis Z of the core. Via this configuration, the cross-section of the envelope surface E may be off-center relative to the core at at least one point along a length of the application element, and, in exemplary embodiments, may be off-center relative to the core at nearly all of the points along the length of the application element 100.

For example, to make the application element, it may be possible to start from a blank including a circularly cylindrical envelope about the axis Z of the core, the blank being rectilinear and coaxial about the longitudinal axis X of the stem, for example, and then to machine the blank to give the blank a desired shape.

The application element 100 may thus comprise bristles of different lengths. For example, longest bristles may always be wiped, whatever adjustment is made by the user on the wiper member. Shortest bristles may, for example, never be wiped regardless of the adjustment made by the user on the wiper member, with composition thus always being stored between the shortest bristles. Bristles of intermediate length may be wiped differently depending on the adjustment made by the user on the wiper member.

Figure 15:
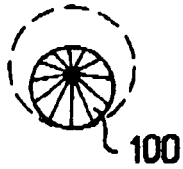
FIGS. 15 and 16 are longitudinal cross-sectional views of the exemplary applicator of FIG. 14.
Figure 16:
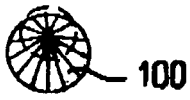

For example, FIGS. 15 and 16 illustrate the application element 100 in the wiper orifice of the wiper member for two different adjustments.

In FIG. 15, the diameter of the wiper member may be selected so that the diameter corresponds to a length of longest projecting elements, such that the application element may be wiped little or not at all.

In FIG. 16, the diameter of the wiper member may correspond to a length of shortest projecting elements, such that the application element may be wiped completely.

Thus, the user may select at will a degree to which the application element is filled with composition and/or the locations of the zones that are filled with the most composition and the zones that are filled with less composition on the application element 100.

To apply makeup, the user may unscrew the applicator 30 and may extract the application element 100 from the receptacle, with the application element being wiped as the application element passes through the wiper member 40.

As a function of the adjustment performed by the user on the wiper member to adjust the inside section as described above, the application element 100 may be wiped in different ways. Wiping may serve to create on the application element 100 zones that are filled with little or no composition, which may be suitable, for example, for combing eyelashes and/or eyebrows, and zones that are very full of composition, that may be suitable to apply the composition on the eyelashes or the eyebrows.

These zones maybe disposed differently or may be of different sizes, depending on the adjustment performed on the wiper member and depending on the size or the shape of the internal section selected by the user.

Thus, with a single application element and a single wiper member, the user may apply makeup so as to produce effects that are different and varied.

Naturally, various modifications are contemplated that may be applied to the applicator and, for example, to the application element.

Figure 14:
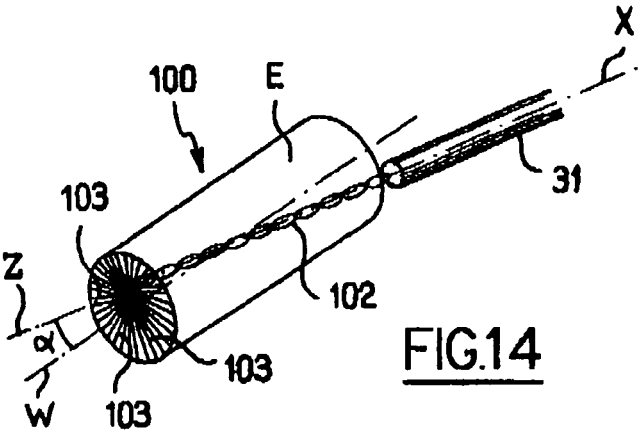
FIG. 14 is a diagrammatic perspective view of the exemplary applicator of FIG. 1.

In exemplary embodiments in FIG. 14, the envelope surface E may be of circular cross-section.

Figure 17:
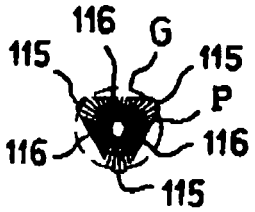
FIGS. 17 to 32 are diagrammatic and fragmentary longitudinal cross-sectional views of various exemplary application elements.

In exemplary embodiments, the envelope surface E of the application element may include a cross-section at at least some point along a length thereof that is not circular. The cross-section may, for example, be polygonal, as illustrated in FIG. 17.

More particularly, in exemplary embodiments, the application element may be of cross-section that is substantially triangular, defining three longitudinal ridges 115 and three substantially plane faces 116 extending between the ridges.

Where appropriate or desired, the user may cause the application element to turn a little about the axis X of the stem. While applying makeup, the ridges 115 may act as a comb to separate eyelashes that might become stuck together by too much composition in certain locations. This combing effect may be made easier, for example, when the circumferential dimension of the ridges 115 may be less than or equal to 2 mm, for example. This may facilitate combing and curving of the eyelashes by enabling the bristles of the application element to penetrate better between the eyelashes.

Figure 18:
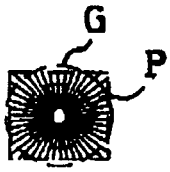
Figure 19:
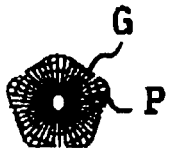
Figure 20:
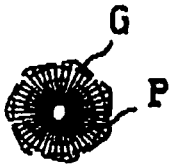

For example, the application element may be given a variety of cross-sections, for example, square as illustrated in FIG. 18, or pentagonal or hexagonal, as illustrated respectively in FIGS. 19 and 20.

Figure 21:
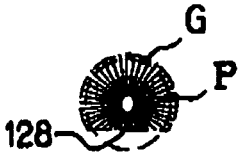
Figure 22:
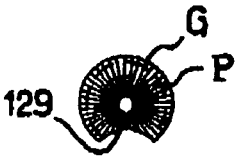
Figure 23:
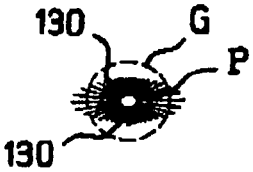

The application element may include at least one face that may be planar or concave. For example, the application element may include an envelope surface of cross-section that may be circular with at least one flat 128, as illustrated in FIG. 21, with at least one side 129 that may be concave, as illustrated in FIG. 22, or with at least one side 130 that may be convex, as illustrated in FIG. 23. As illustrated in FIG. 23, the application element may include an envelope surface of cross-section that may be oblong, and, for example, lenticular in shape.

The application element may include at least one face that may be convex, including a radius of curvature, when the application element is observed in cross-section, that may be greater than a length of a longest bristle extending from the core.

Figure 24:
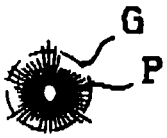
Figure 25:
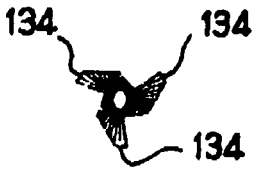
Figure 26:
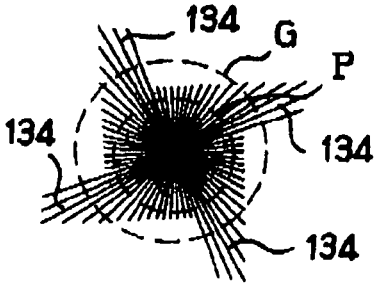
Figure 27:
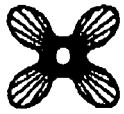
Figure 28:
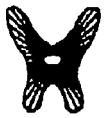
Figure 29:
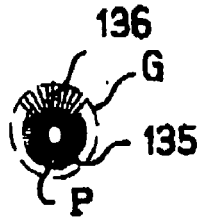

The application element may also include an envelope surface of cross-section that may be star-shaped, as illustrated in FIG. 24, or that forms angular blades 134, for example, three blades, as illustrated in FIG. 25, or four blades, as illustrated in FIG. 26, or that forms rounded lobes, for example, four lobes, as illustrated in FIG. 27, or indeed the cross-section may be H-shaped, as illustrated in FIG. 28. The application element may thus include an envelope surface of cross-section that may be generally in the shape of a keyhole, for example, including short bristles 135 over a major fraction of a circumference thereof and longer bristles 136 over a remainder of the circumference, as illustrated in FIG. 29.

Figure 30:
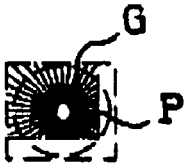
Figure 31:
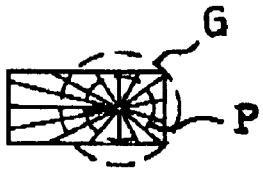
Figure 32:
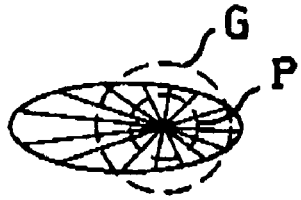

In the exemplary cross-sections illustrated in FIGS. 17 to 29, the cross-section may be centered relative to the core. In exemplary embodiments, the core may also be off-center relative to the cross-section of the envelope surface and at least one point along the brush, as illustrated in FIGS. 30 to 32. In FIG. 30, the cross-section is polygonal in shape, being square, is rectangular in FIG. 31, and is oblong in FIG. 32. Whatever its shape, the cross-section may be centered or off-center relative to the core.

In most of the exemplary cross-sections illustrated in FIGS. 15 to 32, two possible orifices for the wiper member are represented by dashed lines. From these figures, it may be understood that when the wiper member is adjusted so that the internal section thereof corresponds to a larger orifice G illustrated in the figures, the application element may be wiped to a lesser extent than when the wiper member is adjusted so that the internal section corresponds to a smaller orifice P illustrated in the figures.

Given that the cross-section of the envelope surface of the application element is off-center or non-circular, the application element may include bristles of different lengths and an extent to which the bristles are wiped may differ between two different adjustments of the internal section of the wiper member.

For example, longest bristles may always be wiped, shortest bristles may never be completely wiped, while bristles of intermediate length may be wiped to a greater or lesser extent depending on the adjustment selected for the internal section of the wiper member.

Thus, differences in wiping due to the adjustment of the wiper member may be amplified by the shape of the application element.

In the exemplary embodiments illustrated, the wiper orifice is depicted as being circular; however, the wiper orifice may naturally be of some other shape, for example, substantially circular or something else.

As illustrated in FIG. 14, the envelope surface E may be of circular cross-section that is constant over a major fraction of a length of application element, i.e., over an entire length thereof.

It is contemplated that the envelope surface may include at least a portion of cross-section that varies, for example, while keeping a same shape, for example, tapering toward a free end of the application element.

Figure 33:
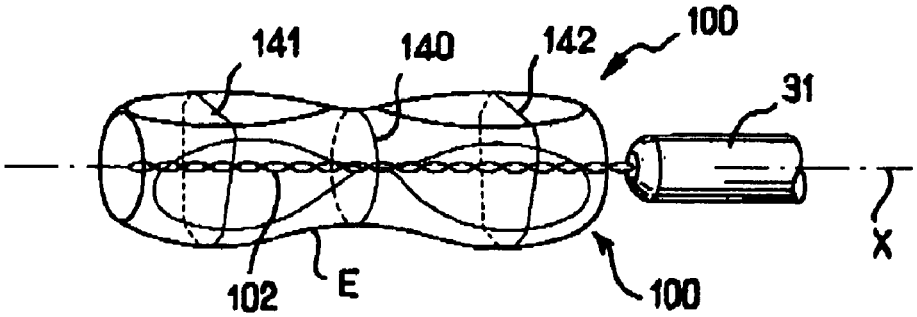
FIGS. 33 to 41 are diagrammatic and fragmentary perspective views of various exemplary application elements.

In exemplary embodiments, the cross-section E of the envelope surface of the application element may pass through at least one extremum between two axial ends thereof, for example, a maximum or a minimum, or indeed both, as illustrated in FIG. 33. As illustrated, the cross-section may pass through a minimum 140 and through two maximums 141 and 142.

Figure 34:
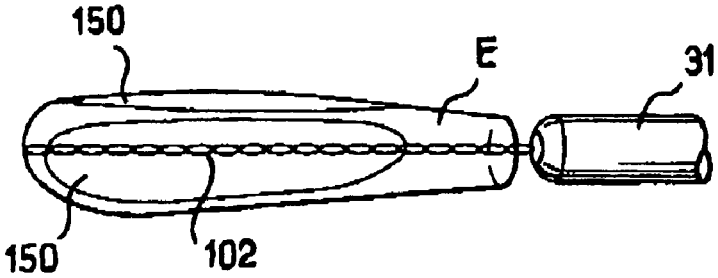

In another exemplary embodiment, the envelope surface of the application element may be non-symmetrical about a mid-plane perpendicular to the core, for example, as illustrated in FIG. 34. As illustrated, the application element may be made from a blank that has had facets 150 cut therein.

Figure 35:
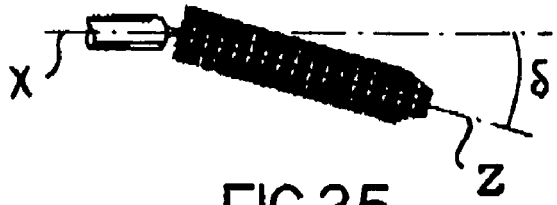

The longitudinal axis Z of the core of the application element may coincide with the longitudinal axis X of the device, or, in exemplary embodiments, the longitudinal axis Z may be different therefrom. For example, FIG. 35 illustrates an exemplary embodiment in which the core of the application element extends along an axis Z making an angle δ with the axis X of the stem. For example, the angle may lie in a range of 1° to 15°.

In exemplary embodiments, the core of the application element may be rectilinear; but, it is contemplated that the core may be of some other shape.

Figure 36:
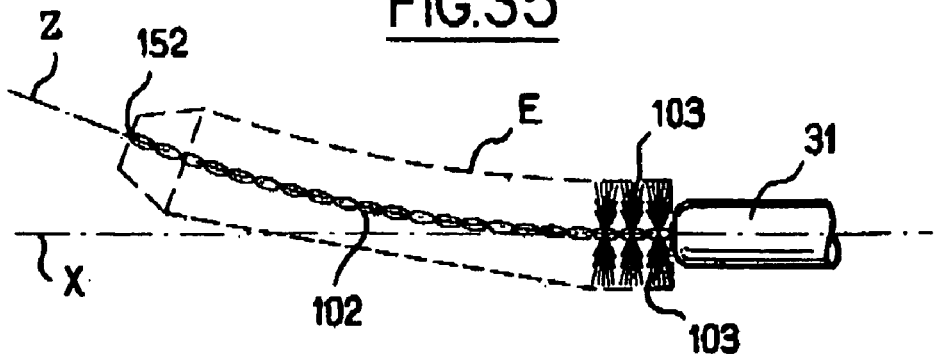
Figure 37:
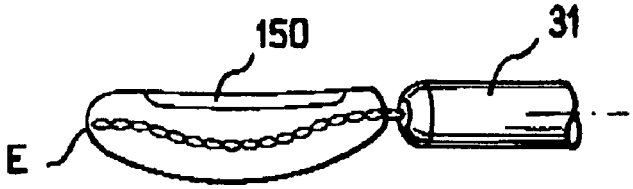
Figure 38:
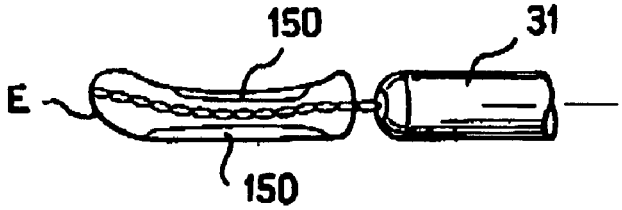

For example, FIGS. 36 to 38 illustrate three exemplary embodiments in which the core of the application element may be curved. As illustrated in FIG. 36, the application element may be configured to include one planar face and one concave face. As illustrated in FIG. 37, the application element may include one planar face 150 and one convex face. As illustrated in FIG. 38, the application element may include two planar faces 150.

Figure 39:
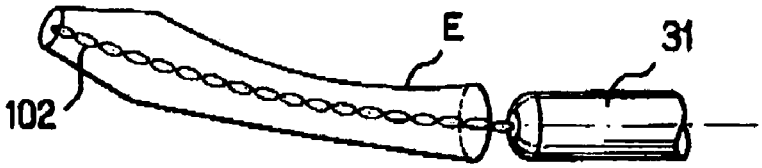

As illustrated in FIG. 39, the application element may include a core 102 that may be curved over at least a fraction of a length thereof and an envelope surface E that may be not symmetrical about a mid-plane perpendicular to the core. In addition, the angle between the axis X of the stem 31 and the axis of the core may be less than 90° at all points along the core. The free end of the application element may be not in alignment with the axis X of the stem.

Figure 40:
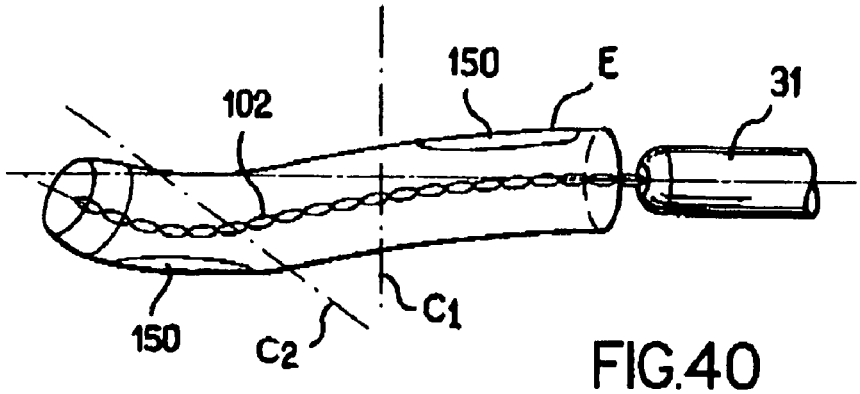

As illustrated in FIG. 40, the application element may be curved about at least two axes $C_1$ and $C_2$ that are not parallel to each other. The axes $C_1$ and $C_2$ may extend in directions that might be perpendicular, for example.

As illustrated in FIG. 36, the application element 100 may include a free end 152 constituting a point of the application element that is furthest from the longitudinal axis X of the device.

In such embodiments, the core of the application element may extend along a longitudinal axis Z lying on one side of a plane containing the longitudinal axis X of the device.

Figure 41:
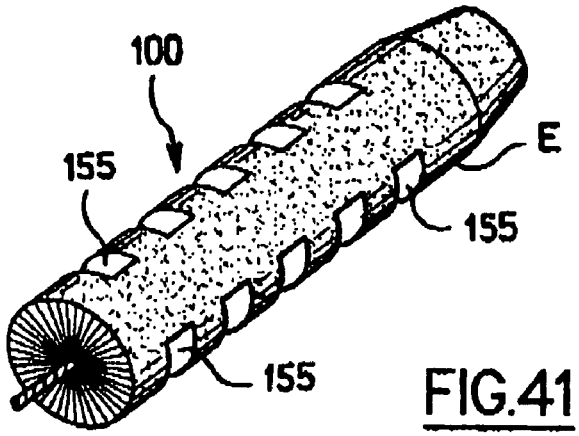

As illustrated in FIG. 41, the application element may be made from a blank in which notches 155 have been cut out.

In cross-section, the notches may be outwardly convex in shape; but, it is contemplated that the notches may include a cross-section that is outwardly concave in shape.

In exemplary embodiments, the core may comprise by a twisted metal wire that serves to hold bristles.

Strands of the core may be given a left-hand twist or a right-hand twist.

It may be particularly advantageous to use a brush with a left-hand twist, as explained below with reference to FIGS. 42 and 43.

Figure 42:
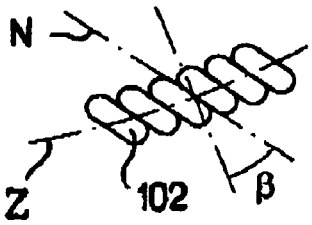
FIGS. 42 and 43 illustrate, respectively, a core with a left-hand twist and a core with a right-hand twist.
Figure 43:
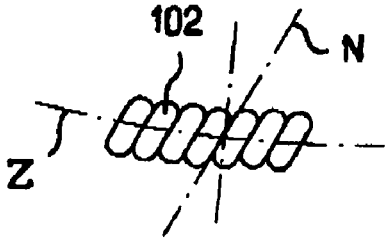

FIG. 42 illustrates a brush with a core that is twisted to the left and FIG. 43 illustrates a core that is twisted to the right. Chain-dotted lines represent the path followed by sheets N defined by the ends of the bristles, these sheets being at an angle β relative to a plane perpendicular to the core. Reference may usefully be made to European patent EP 0 661 170.

Figure 44:
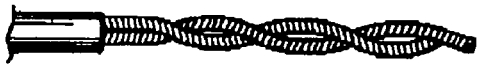
FIG. 44 is a diagram of a dual core formed by winding together two individual twisted cores.

The core may also be a dual core, formed by twisting together two individually twisted cores, as illustrated in FIG. 44. Each individual core may comprise two strands that are twisted together and that hold bristles. Each of the two individual cores may be constituted by one branch of a single twisted core that is folded in half in a U-shape, with the two branches themselves then being twisted together.

In exemplary embodiments, the bristles may be held in orifices formed in the core of the application element.

In exemplary application elements, it may be possible to use bristles of all kinds, for example, bristles including a cross-section that is circular or non-circular. For example, it may be possible to use a mixture of bristles of different kinds or a mixture of bristles of different lengths, being of the same or different kinds.

For example, it may be possible to use bristles including a cross-section including any one of the following shapes: a shape that is circular with a flat, a flattened shape, a star-shape, for example, in the form of a cross or including three points, a U-shape, an H-shape, a T-shape, a V-shape, a hollow shape, for example, circular or square with ramifications, for example, in the form of a snowflake, a section that is prismatic, for example, triangular or square or hexagonal or of oblong shape, for example, of ventricular shape or hourglass shape. It may be possible to use bristles including portions that are hinged relative to one another. It may be also possible to use bristles that include at least one capillary groove.

The bristles may be held between the twisted strands of the core and, prior to being put into place between the strands of the core, the bristles may be of rectilinear or other shape. For example, the bristles may be of undulating shape.

The bristles may be subjected to treatment that seeks to form beads or forks at ends of the bristles. It may be possible to use bristles that are flocked or indeed bristles made by extruding a plastics material containing a particulate filler, for example, comprising particles of a material that absorbs moisture, so as to impart microrelief to the surface of the bristles, or so as to give the bristles magnetic or other properties. The bristles may also be made of a material that includes properties that enhance sliding.

The bristles may be natural or synthetic, and, for example, may be made of a material selected from: PE, PA, for example PA6, PA6/6, PA6/10, or PA6/12, HYTREL®, PEBAX®, silicone, PU, this list not being limiting.

Figure 45:
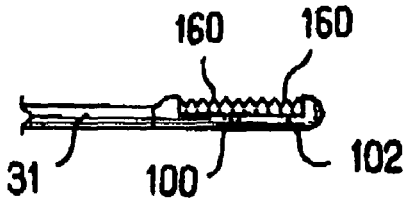
FIG. 45 illustrates another exemplary application element.
Figure 46:
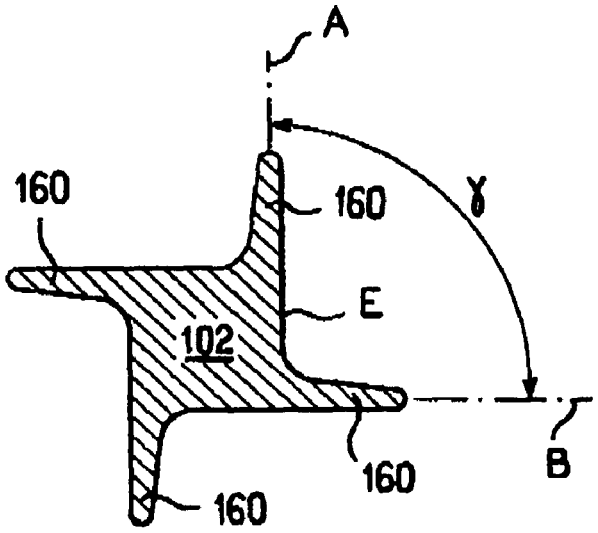
FIGS. 46 and 47 are diagrammatic and fragmentary longitudinal cross-sectional views of various exemplary application elements.
Figure 47:
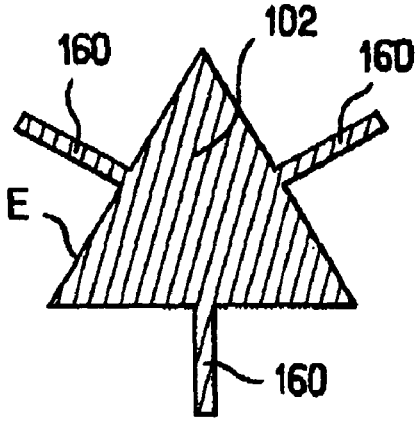
Figure 48:
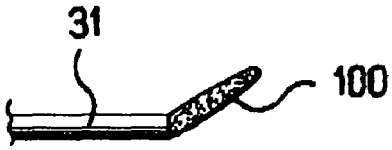
FIG. 48 is a diagrammatic and fragmentary perspective view of another exemplary application element.

The invention is not limited to a particular type of application element, and, for example, the application element may be other than a mascara brush, for example, being a comb as illustrated in FIGS. 45 to 47, an optionally locked endpiece, for example, made of elastomer, felt, or foam, as illustrated in FIG. 48. The application element may include a maximum transverse dimension that is less than or greater than a diameter of the stem 31.

In FIGS. 45 to 47, the application element may include teeth 160 made integrally, i.e., monolithically, with the core.

The teeth may be made by molding, for example, by injection-molding together with the core, or else by machining or stamping.

The envelope surface E of the comb may be defined by the shape of its cross-section.

As illustrated in FIG. 45, the application element 100 may include a single row of teeth 160 extending parallel to the longitudinal axis of the device.

Naturally, it is contemplated that the application element may include some other number of rows of teeth, for example, at least two rows.

For example, FIG. 46 illustrates an exemplary embodiment in which the application element 100 may include four rows of teeth 160, and FIG. 47 illustrates an exemplary embodiment in which the application element 100 may include three rows of teeth 160.

In these two embodiments, at least two teeth may extend in different respective directions A, B from the core. The directions A, B may make an angle γ therebetween, for example, an angle substantially equal to 90°.

In FIG. 46, at least one of the rows of teeth may substantially extend at least one face of the core.

The core 102 of the application element may include a cross-section of a shape selected from: oval, oblong, elliptical, lenticular, circular, polygonal, triangular as illustrated in FIG. 47, square as illustrated in FIG. 47, pentagonal, hexagonal, or indeed octagonal.

In general, the application element may be selected from application elements that define an envelope surface including at least one cross-section that is off-center relative to the core and/or that is non-circular. Examples are described in the following patents or patent applications, the content of which is incorporated herein by reference:

U.S. Pat. Nos. 6,581,610, 6,412,496, 6,539,950, 6,343,607, 6,866,046, 6,814,084, 6,675,814, 6,446,637, 6,546,937, 6,655,390 and 6,662,810; U.S. patent application Ser. No. 09/860,601; and U.S. Patent Application Publications Nos. 2002/0124860, 2002/0139385, 2003/0089379, 2003/0178043, 2003/0213498, 2004/0134507, 2004/0226573, and 2004/0240926.

Figure 49:
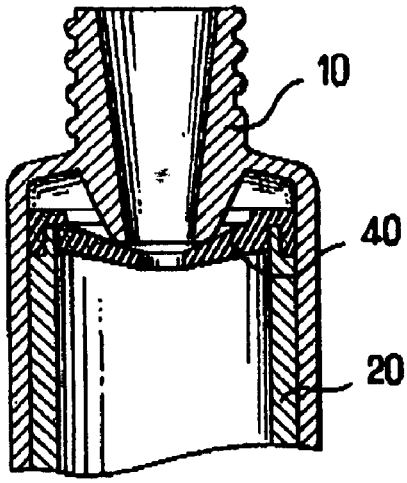
FIGS. 49 to 51 are diagrammatic and fragmentary longitudinal cross-sectional views of another exemplary embodiment, respectively illustrating the first and second elements in two different relative positions.

The wiper member 40 may also be made in some other way, for example, comprising a stationary membrane that is deformable by longitudinal displacement of a rigid hollow element 10, as illustrated in FIG. 49. The element 10 may be turned relative to the receptacle 20. The two elements 10 and 20 may co-operate via at least one helically-shaped portion in relief, for example, so that turning movement generates displacement in translation of one element relative to the other.

Figure 50:
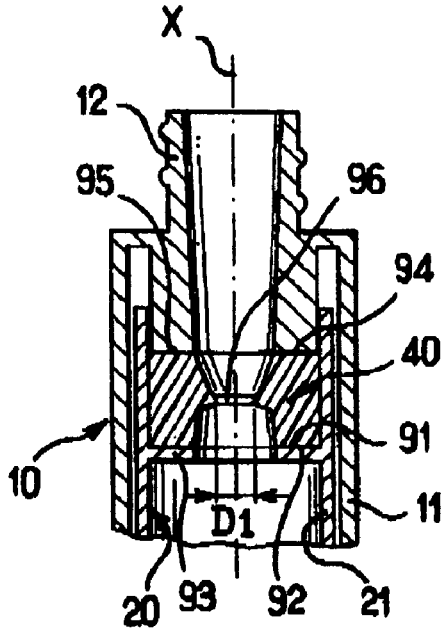
Figure 51:
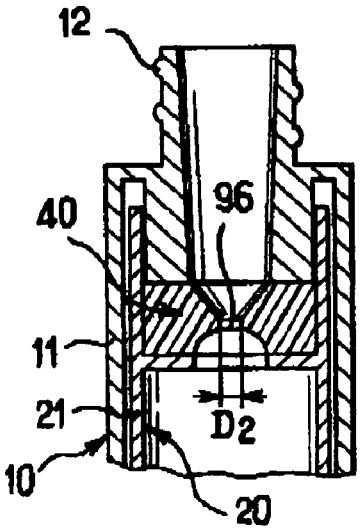

The wiper member may also be made differently, and, for example, need not work in elongation, but may work in compression, as illustrated in FIGS. 50 and 51.

As illustrated, a device in which the bottom portion that is not illustrated may be, for example, the same as that of the device in FIGS. 1 and 2, may include a top portion that is been modified in such a manner as to receive a wiper member 40 made of a material that may be elastically deformable.

The wiper member 40 may include a bottom face 91 resting on a shoulder 92, for example, constituted by an annular rib 93 of the body 21, while a top face 94 presses against the bottom edge 95 of an internal extension of the first element 10.

When the second element 20 is in a configuration where the second element 20 is least engaged in the first element 10, the wiper member 40 may be not compressed or little compressed, such as to provide an opening 96 that is relatively large, for example, including a first diameter $D_1$.

In exemplary embodiments, the wiper member may be compressed otherwise, for example, by moving the adjustment member in translation relative to the receptacle.

Figure 52:
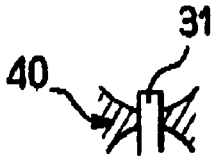
FIG. 52 illustrates the possibility of including a leaktight contact between the stem and the wiper member.

When the second element 20 is moved angularly relative to the first element 10 so as to become further engaged in the first element 10, the wiper member 40 may be compressed to a greater extent between the first element 10 and the second element 20, so the diameter of the opening 96 becomes smaller and takes on a second value $D_2$ less than $D_1$.

Where appropriate or desired, the wiper member 40 may bear in a leaktight manner against the stem 31 when the diameter of the opening 96 is small, as illustrated in FIG. 52.

The wiper member may also be replaced by a flow reducer.

Figure 53:
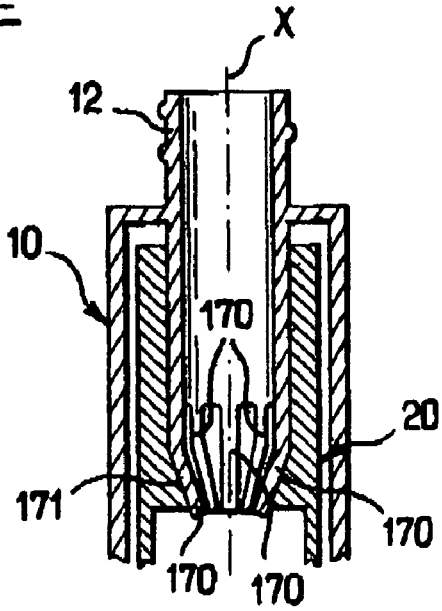
FIG. 53 is a fragmentary and diagrammatic longitudinal cross-sectional view of another exemplary wiper member.

The wiper member may also be made at least in part as a single piece with one or the other of the first and second elements, as illustrated in FIG. 53.

In such exemplary embodiments, the first element 10 may be made with an internal extension that terminates in a plurality of flexible tongues 170. The tongues may be engaged in the second element and may come to press against a surface 171 thereof. For example, the surface 171 may be conical, converging toward the bottom of the receptacle.

Free ends of the tongues may define an opening for passing the application element, and the user may vary a diameter of the opening by varying the axial position of the first element relative to the second.

When the internal extension of the first element pushes into the second element, the tongues may be deflected radially inward, thereby decreasing the diameter of the wiper orifice.

When the first element rises, the tongues may tend to splay apart because of their own resilience, and the diameter of the wiper orifice may increase.

When the tongues have risen sufficiently, the diameter of the wiper orifice may be defined by a radially inner edge of the surface 171.

Figure 54:
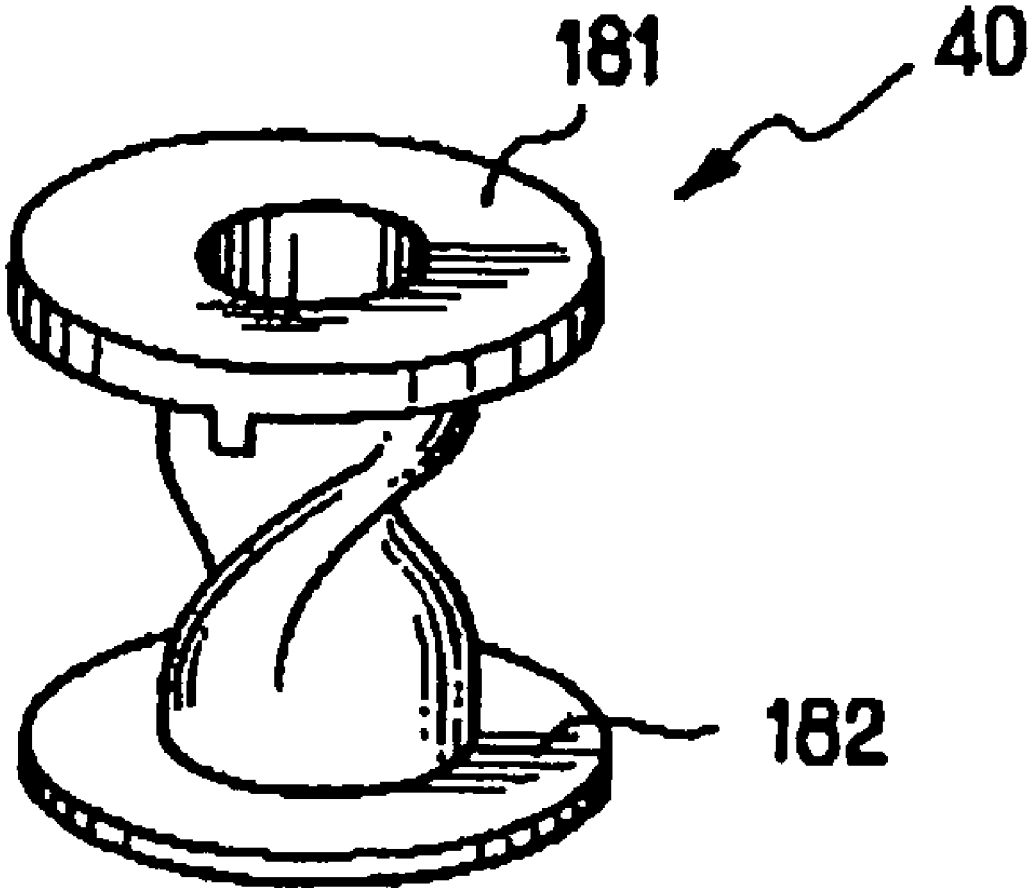
FIG. 54 is a diagrammatic and fragmentary perspective view of another exemplary wiper member.

In exemplary embodiments, the wiper member may be configured to deform in shear, the adjustment member being configured, for example, so as to turn a first end 181 of the wiper member 40 relative to a second end 182 of the wiper member 40, as illustrated in FIG. 54. Since the wiper member is elastically deformable, the wiper member deforms in twisting so that the inside section thereof becomes smaller.

The invention is not limited to the embodiments described above.

The characteristics of the various exemplary embodiments described may, for example, be combined with one another to constitute embodiments that are not illustrated.

The wiper member may be made in other ways as well, for example, in the manner described in FR 2 515 941, for example.

The invention may also apply to a method of applying a composition, for example, a cosmetic, for example, mascara, using of any of the exemplary devices, the method comprising:

i) performing a first adjustment of the inside section of the wiper member;

ii) withdrawing the application element from the receptacle to apply the composition, for example, on eyelashes or eyebrows;

iii) performing a second adjustment of the inside section of the wiper member, different from the first adjustment; and iv) withdrawing the application element from the receptacle.

In the second adjustment, the inside section of the wiper member may be smaller, so that wiping is stronger.

Thus, after step iv), it may be possible, for example, to comb the eyelashes or the eyebrows with a more thoroughly wiped application element.

The term "comprising a" should be understood as being synonymous with "comprising at least one", unless specified to the contrary.

Although various details of the present invention herein include been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention.

What is claimed is:

1. A device for packaging and applying a composition, the device comprising:

a receptacle configured to contain the composition;

an application element configured to apply the composition, the application element comprising a core and projecting elements that extend from the core, the application element defining an envelope surface including at least one cross-section that is at least one of off-center relative to the core and non-circular, the at least one cross-section being perpendicular to a longitudinal axis of the envelope surface;

at least one wiper member configured to wipe the application element;

at least one adjustment member configured to act on the wiper member to modify an inside section of the wiper member, the adjustment member being movable in at least one of turning and translation relative to the wiper member;

a first element including an axis and comprising at least one slot that does not extend entirely perpendicularly to the axis; and a second element engaged at least partially in the first element and configured to be capable of turning relative thereto about the axis and capable of moving axially within the first element, the second element including at least one lug engaged in the slot and visible from outside the device, the slot and the lug being configured in such a manner that displacement of the lug within the slot during relative turning of the first and second elements causes the two elements to be moved axially relative to each other, and the modification of the wiper member being a result of relative movement between the first element and the second element.

2. A device according to claim 1, wherein the envelope surface includes a cross-section that is constant over a major fraction of a length of the application element.

3. A device according to claim 1, wherein the envelope surface includes at least a fraction including a cross-section that varies.

4. A device according to claim 1, wherein the envelope surface includes at least a fraction including a cross-section that varies while maintaining a same shape.

5. A device according to claim 1, wherein a cross-section of the envelope surface of the application element passes through at least one extremum between two axial ends of the envelope surface.

6. A device according to claim 5, wherein the extremum is one of a maximum and a minimum.

7. A device according to claim 1, wherein a cross-section of the envelope surface at least one point along the core includes a general shape that is selected from: polygonal, triangular, square, pentagonal, hexagonal, oblong, oval, elliptical, lenticular, star-shaped, a star including three to six points, and keyhole-shaped.

8. A device according to claim 1, wherein a cross-section of the envelope surface is off-center relative to the core at least one point along a length of the application element.

9. A device according to claim 1, wherein the envelope surface extends along a longitudinal axis forming a non-zero angle with a longitudinal axis of the core.

10. A device according to claim 1, wherein the envelope surface extends along a longitudinal axis on one side of a plane containing a longitudinal axis of the device.

11. A device according to claim 1, wherein the application element includes a free end constituting a point of the application element furthest from a longitudinal axis of the device.

12. A device according to claim 1, wherein the core of the application element is rectilinear.

13. A device according to claim 1, wherein the core of the application element is curved.

14. A device according to claim 1, wherein the application element is curved about at least two axes that are not mutually parallel.

15. A device according to claim 14, wherein the axes extend in respective directions that are perpendicular.

16. A device according to claim 1, wherein the envelope surface of the application element is non-symmetrical about a midplane perpendicular to the core.

17. A device according to claim 1, wherein the projecting elements comprise bristles extending from the core.

18. A device according to claim 17, wherein the bristles are resilient.

19. A device according to claim 17, wherein the core is injection-molded onto the bristles.

20. A device according to claim 17, wherein the bristles are secured in orifices formed in the core of the application element.

21. A device according to claim 17, wherein the core comprises at least one twisted metal wire forming turns in which the bristles are held.

22. A device according to claim 17, wherein the application element is made from a blank in which at least one of a notch and a facet is cut.

23. A device according to claim 22, wherein a plurality of notches are formed in the blank including a cross-section that is outwardly convex in shape.

24. A device according to claim 17, wherein the application element includes at least one longitudinal ridge.

25. A device according to claim 17, wherein the envelope surface of the application element comprises at least one of a planar face and a concave face.

26. A device according to claim 17, wherein the application element includes at least one convex face including a radius of curvature, when the application element is observed in cross-section, that is greater than a length of a longest bristle extending from the core.

27. A device according to claim 1, wherein the application element comprises teeth that are monolithic with the core.

28. A device according to claim 27, wherein at least two of the teeth extend from the core along two different directions.

29. A device according to claim 27, wherein the application element comprises at least one row of teeth.

30. A device according to claim 29, wherein the at least one row of teeth substantially extends at least one face of the core.

31. A device according to claim 27, wherein the core includes a cross-section selected from: oval, oblong, elliptical, lenticular, circular, polygonal, triangular, square, pentagonal, hexagonal, and octagonal.

32. A device according to claim 27, wherein the teeth comprise at least one of molded teeth, machined teeth, and stamped teeth.

33. A device according to claim 27, wherein the teeth and core comprise an injection-molded structure.

34. A device according to claim 1, wherein the application element comprises teeth and the core is injection-molded onto the teeth.

35. A device according to claim 1, wherein the application element comprises a flocked endpiece.

36. A device according to claim 35, wherein the endpiece comprises at least one of an elastomer material, a felt, and a foam.

37. A device according to claim 1, wherein the application element is secured to an end of a stem.

38. A device according to claim 37, wherein the stem is connected to a handle member.

39. A device according to claim 38, wherein the handle member is configured as to close in a leaktight manner the receptacle containing the composition for application.

40. A device according to claim 37, wherein an angle between a longitudinal axis of the stem and a longitudinal axis of the core is less than 90° at all points therealong.

41. A device according to claim 1, wherein the wiper member is configured to deform in elongation.

42. A device according to claim 1, wherein the wiper member is configured to deform in compression.

43. A device according to claim 1, wherein the wiper member is configured to deform by splaying out.

44. A device according to claim 1, wherein the wiper member is configured to deform in shear.

45. A device according to claim 1, wherein the adjustment member is configured to turn a first end of the wiper member relative to a second end of the wiper member.

46. A device according to claim 1, wherein the lug is a single lug.

47. A device according to claim 1, further comprising, on an outside surface, at least one visible mark associated with a relative position of the first and second elements.

48. A device according to claim 1, wherein the first and second elements are configured to enable the lug to be inserted in the slot by elastic deformation of at least one of the first and second elements while the second element is being moved inside the first.

49. A device according to claim 1, wherein the first element comprises an inside surface including at least one groove configured to facilitate displacement of the lug between an end of the first element through which the second element is inserted, and the slot.

50. A device according to claim 1, wherein the wiper member comprises a plurality of flexible tongues.

51. A device according to claim 1, wherein the wiper member includes a central portion including a transverse wall pierced by an opening, and wherein the first element comprises an internal extension that is configured to press to a greater or lesser extent on the transverse wall to modify a shape of the opening.

52. A device according to claim 1, the adjustment member being configured to enable the inside section of the wiper member to be modified in a continuous manner.

53. A device according to claim 1, wherein the wiper member comprises a single wiper member.

54. A device according to claim 1, wherein at least a portion of the adjustment member is axially movable.

55. A device according to claim 1, wherein movement of the adjustment member with respect to the wiper member is a simple rotation.

56. A device according to claim 1, wherein movement of the adjustment member with respect to the wiper member is a simple translation.

57. A device according to claim 1, the wiper member being configured to deform at least one of in elongation, in compression, in shear, and by splaying out.

* * * * *